US008079652B2

(12) United States Patent
Laible et al.

(10) Patent No.: US 8,079,652 B2
(45) Date of Patent: Dec. 20, 2011

(54) CONNECTION SYSTEM FOR CONNECTING A BUILT-IN APPLIANCE TO A FURNITURE UNIT AND FURNITURE UNIT ARRANGEMENT

(75) Inventors: Karl-Friedrich Laible, Langenau (DE); Hans-Philipp Reitz, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 756 days.

(21) Appl. No.: 12/085,651

(22) PCT Filed: Oct. 23, 2006

(86) PCT No.: PCT/EP2006/067665

§ 371 (c)(1), (2), (4) Date: May 27, 2008

(87) PCT Pub. No.: WO2007/062928

PCT Pub. Date: Jun. 7, 2007

(65) Prior Publication Data

US 2009/0165268 A1 Jul. 2, 2009

(30) Foreign Application Priority Data

Nov. 30, 2005 (DE) ..... 10 2005 057 144

(51) Int. Cl.
*A47B 67/02* (2006.01)

(52) U.S. Cl. ..... 312/242; 312/401; 312/140.1

(58) Field of Classification Search ..... 312/242, 312/401, 249.9, 140.1, 107, 108; 52/287.1, 52/712, 713

See application file for complete search history.

(56) References Cited

U.S. PATENT DOCUMENTS 1,257,097 A * 2/1918 Morris ..... 312/107
2,599,322 A * 6/1952 Drain ..... 52/278
3,351,400 A * 11/1967 Sholtes ..... 312/111
3,352,615 A * 11/1967 Sandin ..... 312/111

(Continued)

FOREIGN PATENT DOCUMENTS

DE 79 15 766 U 11/1980

(Continued)

OTHER PUBLICATIONS

International Search Report PCT/EP2006/067665.

*Primary Examiner* — Darnell Jayne
*Assistant Examiner* — Daniel Rohrhoff
(74) *Attorney, Agent, or Firm* — James E. Howard; Andre Pallapies

(57) ABSTRACT

A connection system for connecting a built-in appliance to a furniture unit is provided and includes a securing strip having first securing elements for securing to the furniture unit side of the securing strip and second securing elements for securing to the appliance side of the securing strip and at least one cover strip which can be attached to the securing strip. Said securing strip comprises at least one recess for securing the cover strip to the securing strip. The invention also relates to a furniture unit arrangement, in particular a kitchen range, comprising a plurality of furniture units, wherein at least one furniture unit comprises a niche, and at least one built-in appliance. The built-in appliance is built into the niche. The built-in appliance is connected to the furniture unit by means of the inventive connection system.

27 Claims, 7 Drawing Sheets

U.S. PATENT DOCUMENTS

| | | | | |
|---|---|---|---|---|
| 3,680,152 | A * | 8/1972 | Farrell | 4/633 |
| 3,746,417 | A * | 7/1973 | Sasnett | 312/198 |
| 5,350,227 | A * | 9/1994 | Katz | 312/198 |
| 6,883,282 | B1 * | 4/2005 | Newhart, III | 52/287.1 |
| 6,899,404 | B1 * | 5/2005 | King | 312/111 |
| 7,293,847 | B2 * | 11/2007 | Lee et al. | 312/406.2 |
| 7,685,846 | B2 * | 3/2010 | Hwang et al. | 68/3 R |
| 7,845,745 | B2 * | 12/2010 | Gorz et al. | 312/401 |
| 2009/0056252 | A1 * | 3/2009 | Taylor et al. | 52/287.1 |
| 2009/0165268 | A1 * | 7/2009 | Laible et al. | 24/589.1 |

FOREIGN PATENT DOCUMENTS

| | | |
|---|---|---|
| DE | 296 21 598 U | 2/1997 |
| EP | 0 441 363 | 8/1991 |

* cited by examiner

CONNECTION SYSTEM FOR CONNECTING A BUILT-IN APPLIANCE TO A FURNITURE UNIT AND FURNITURE UNIT ARRANGEMENT

BACKGROUND OF THE INVENTION

The invention relates to a connection system for connecting a built-in appliance to a furniture unit, in particular to a furniture recess, and a furniture unit arrangement, in particular a kitchen range, comprising a plurality of furniture units, with the furniture unit arrangement comprising at least one furniture unit with a recess and at least one built-in appliance built into the recess.

It is known to build built-in appliances or under-worktop appliances into a recess of a furniture unit wall and to secure them there to the furniture unit wall. For this, the built-in appliance itself can have connecting elements such as, for example, protruding sheet-metal strips, which are screwed on or in the furniture recess.

With this type of securing, problems occur in particular when the built-in appliance has slightly different dimensions than those provided by the furniture recess so that the built-in appliance has to be arranged at least partially with a space from an inner wall of the recess.

To resolve this problem, as a rule, the furniture recess is packed or reduced, but this usually requires further joinery or requires a comparatively long amount of time to produce special connecting elements which fit.

In addition, as a rule, the gap between the built-in appliance and the furniture recess has to be lined with paneling. The paneling is usually installed independently of the actual securing of the built-in appliance separately on the recess. Once again, this requires a significant amount of assembly work to produce suitable paneling which fits and to secure it on the recess.

BRIEF SUMMARY OF THE INVENTION

It is the object of the present invention, to specify a connection system for connecting a built-in appliance to a furniture unit, in particular to a furniture recess, and a furniture unit arrangement, in particular a kitchen range, so that the built-in appliance can be reliably installed in or on a furniture unit with little time expenditure only, even if the dimensions of the built-in appliance and of the furniture unit do not match.

This object is achieved by the connection system for connecting a built-in appliance to a furniture unit and by the furniture unit arrangement as disclosed in the respective independent claims. Further advantageous embodiments and developments, which can each be used individually or optionally combined in a suitable way with each other are the subject matter of the respective dependent claims.

The connection system according to the invention for connecting a built-in appliance to a furniture unit, in particular to a furniture recess, comprises a securing strip with first securing elements for securing to the furniture unit side and with second securing elements for securing to the appliance side, and at least one cover strip, with the securing strip having at least one receptacle for securing the cover strip.

The securing strip is used to connect the built-in appliance to the furniture unit, in particular to the furniture recess in a reliable, solid and mechanically stable way. For this, the securing strip is in particular made of a metal. The securing strip is secured with the first securing elements on the furniture unit and with the second securing elements on the built-in appliance. The securing strip can be secured on the furniture unit side and/or appliance side by means of screws, hooks, clip elements, rivets, nails or other means.

The securing strip can be arranged vertically or horizontally between the built-in appliance and the furniture unit arranged thereabove, therebelow or adjacent thereto.

The built-in appliance can be a washing machine, a dishwasher, a refrigerator, a cooker, an oven, a microwave, an extractor hood, a stove or another kitchen appliance. The built-in appliance can also be provided as an under-worktop appliance, that is as an appliance which is not fully inserted into a furniture recess, but stands independently on the floor.

The securing strip has at least one receptacle in order to secure the cover strip. The cover strip is used to cover the junction between the built-in appliance and the furniture unit.

The covering strip has, on the one hand, an optical function in order to cover the junction between the built-in appliance and the furniture unit and, on the other, it should prevent the penetration of dirt, dust and other contaminants into the intermediate space between the built-in appliance and the furniture unit, in particular into the gap between them. Therefore, both optically and functionally, the connection system performs the function of paneling.

The cover strip can be made of plastic and/or metal. It can also comprise wooden elements.

Advantageously, at least two cover strips are provided and the securing strip has at least two receptacles for securing the two cover strips.

The versatility of the paneling can be increased by means of at least two cover strips. In particular, two cover strips can be used to cover gaps of different widths between the built-in appliance and the furniture unit or junctions of different widths. For this, the cover strips are secured parallel to each other and at least partially overlapping on the securing strip, with the degree or the size of the overlapping region between the two cover strips being dependent upon or selected according to the gap to be bridged or the size of the junction area to be covered.

The cover strips are secured on the securing strip, with the cover strips being preferably hooked-in, inserted, clipped on or clamped.

Advantageously, at least one of the two cover strips has connecting elements, in particular latching elements, by means of which the cover strips can be connected to each other. The connectability of the cover strips to each other achieves an additional stabilization of the cover strips. The cover strips are preferably connected directly to each other and along a line. Preferably, the cover strips rest along a line. It is also possible for the cover strips only to be connected to each other in regions or by point contact. The cover strips can be hooked to each other, inserted in one another, clipped to each other or clamped.

The two cover strips are preferably arranged with an overlap, in particular according to a groove and tongue principle. The overlap extends in particular along a longitudinal side of the covering strips.

Advantageously, the overlap is adjustable in different ways, in particular adjustable in steps. For this, at least one of the cover strips can be made shorter or narrower. In particular, the covering strip can be made narrower. The connecting elements are advantageously designed to enable securing with different overlaps. This enables the cover strips to be secured to each other if the widths of the junction between built-in appliance and furniture recess are different. The cover strips can in particular be spaced at different widths from each other. Gaps of different widths between the built-in appliance and the furniture unit can be bridged or covered by a suitably selected spacing of the cover strips, with the overlap of the cover strips ensuring that the paneling provides a seal and is free of gaps.

Advantageously, the cover strip has cover-strip-side latching elements for a latching connection of the cover strip to the securing strip. The cover-strip-side latching elements enable an, in particular detachable, securing of the cover strip on the securing strip. The cover strip is, for example, clipped or clamped on the securing strip. The securing of the cover strip on the securing strip in particular does not involve any screws.

The securing strip has in particular securing-side latching elements for the latching connection of the cover strip to the securing strip. The securing-side latching elements, that is the latching elements provided on the securing strip, prevent the unintentional detachment of the cover strip from the securing strip. Advantageously, however, the cover strip can be detached from the securing strip and replaced. The securing-side latching elements are advantageously provided as a counterpiece to the cover-strip-side latching elements so that the securing-side and cover-strip-side latching elements interact and enable a solid and in particular detachable securing of the at least one cover strip on the securing strip.

In an advantageous embodiment of the invention, the securing strip has at least one appliance-side recess to create an appliance-side groove between the securing strip and the built-in appliance. The cover strip can be inserted into the appliance-side recess. The appliance-side recess on the securing strip interacts in particular with the built-in appliance in order to form a receptacle for the cover strip. The appliance-side recess can, for example, be formed by a projection on the securing strip, with the projection being supported on the built-in appliance. This projection serves in particular to secure the securing side on the built-in appliance. The gap formed between the securing strip and the built-in appliance next to the projection, which forms the appliance-side recess, can then serve as a receptacle for the cover strip.

The securing strip advantageously has at least one furniture-unit-side recess to create a furniture-unit-side groove between the securing strip and the furniture unit, into which the cover strip can be inserted. In the same way as the appliance-side recess, the furniture-unit-side recess creates a gap between the furniture unit, which can serve as a receptacle for the cover strip. In a similar way as the appliance-side recess, the furniture-unit-side recess can be formed from a projection on the securing strip extending toward the furniture unit, with the projection being supported on the furniture unit and the projection in particular being secured to the furniture unit. The furniture-unit-side recess is located in a corresponding way between the securing strip and the furniture unit and hence offers the possibility of the securing of the cover strip.

Advantageously, the securing elements have holes for screws.

In a special embodiment of the invention, the securing strip has a flat-ribbon shape and a longitudinal direction and has at least one, preferably at least two, folding lines extending parallel to the longitudinal direction for setting an overall height of the securing strip. In particular, the folding line enables a different overall height in a range of 1-20 mm, preferably in a range of 1-10 mm, to be set. The overall height generally substantially corresponds to the distance between the built-in appliance and the furniture unit to be bridged by the securing strip. This makes it possible, to build the built-in appliance solidly into a (slightly over-dimensioned) furniture recess, which is not optimally adapted to the built-in appliance. For example, a built-in appliance with the securing strip can still be built into the recess if there is a gap of 15 mm between the built-in appliance and the recess. The securing strip with the folding lines means no further measures are required to bridge the gap between the built-in appliance and the furniture unit.

The folding lines enable the securing strip to be bent in a suitably simple way in order to achieve the adaptation of the overall height. An installer can adapt the securing strip by simply bending the securing strip along the folding lines and rapidly create a reliable securing of the built-in appliance on the furniture unit or on the furniture recess for different widths of the junction between the built-in appliance and furniture unit. This is in particular also possible if the built-in appliance is arranged at a comparatively wide distance from furniture unit.

The folding lines can be formed by cut-outs, in particular punched-out portions.

A flat-ribbon shape means that the securing strip is substantially a tape which is at least three times as long as it is wide. The width of the securing strip is in particular in a range of 15 mm-100 mm, in particular in a range of 20 mm-50 mm. The length of the securing strip is in particular at least 100 mm, in particular at least 300 mm, preferably at least 600 mm. The thickness of the securing strip, that is the thickness of the material used, in particular of the sheet used, is in particular in a range of 0.5-2 mm, in particular in a range of 1 mm-1.5 mm.

In an advantageous embodiment of the invention, the securing strip has a flat-ribbon shape and a longitudinal direction, with the securing strip having at least one transverse folding line extending perpendicularly to the longitudinal direction for securing the securing strip on a surface extending transverse to the longitudinal direction, in particular on a side wall of the furniture recess. The transverse folding line enables a part of the securing strip to be bent transverse to longitudinal direction so that the securing strip can be secured to this part on an adjacent furniture unit or the side wall of the recess. The folding angle in the plane perpendicular to the transverse folding line can lie in a range of 0° to 180°. With adjacent vertical surfaces and a horizontally arranged securing strip, the folding angle is approximately 90°.

The transverse folding lines are in particular formed by formed by cut-outs, in particular punched-out portions.

Advantageously, the cover strip has a longitudinal side, the width of which can be reduced by means of a break-off edge. The reduction of the width enables the cover strip to be adapted to the width of a junction to be covered. This makes the cover strip narrower. The break-off edge simplifies the reduction of the width of the cover strip so that the cover strip can be made narrower in a simple and rapid way by breaking off a part of the cover strip along the break-off edge. The break-off edge extends in particular along a longitudinal direction of the cover strip. In cases where two cover strips are provided which are arranged with an overlap, it is advantageous for the break-off edge to be provided on the one cover strip which is covered by the other cover strip so that, after the breaking-off of a part of the one cover strip, the break-off edge is no longer visible and is covered by the other cover strip.

The furniture unit arrangement according to the invention, in particular a kitchen range, comprising a plurality of furniture units, with at least one furniture unit having a recess, and with at least one built-in appliance, with the built-in appliance being built into the recess, provides that the built-in appliance is connected to the furniture unit by the connection system according to the invention.

The use of the connection system according to the invention means the furniture unit arrangement is particularly simple to install and has particularly high reliability and stability with respect to the connection between the built-in appliance and the furniture unit. The connection system according to the invention provides a versatile covering concept for any kitchen environment offering a high degree of comfort for the installer and hence reducing installation costs. The connection system has a tolerance-compensating function requiring only a comparatively low level of complexity.

The use of a cover strip with a reducible width enables different clearances between the built-in appliance and an adjacent furniture unit, in particular a wall cupboard arranged thereabove, to be compensated.

BRIEF DESCRIPTION OF THE DRAWINGS

Further advantageous details and special embodiments, which can each be used individually or combined with each other in a suitable way will be described with reference to the following drawings which are not intended to restrict the invention but only to illustrate it by way of example and which show.

DETAILED DESCRIPTION OF THE PRESENT INVENTION

Figure 1:
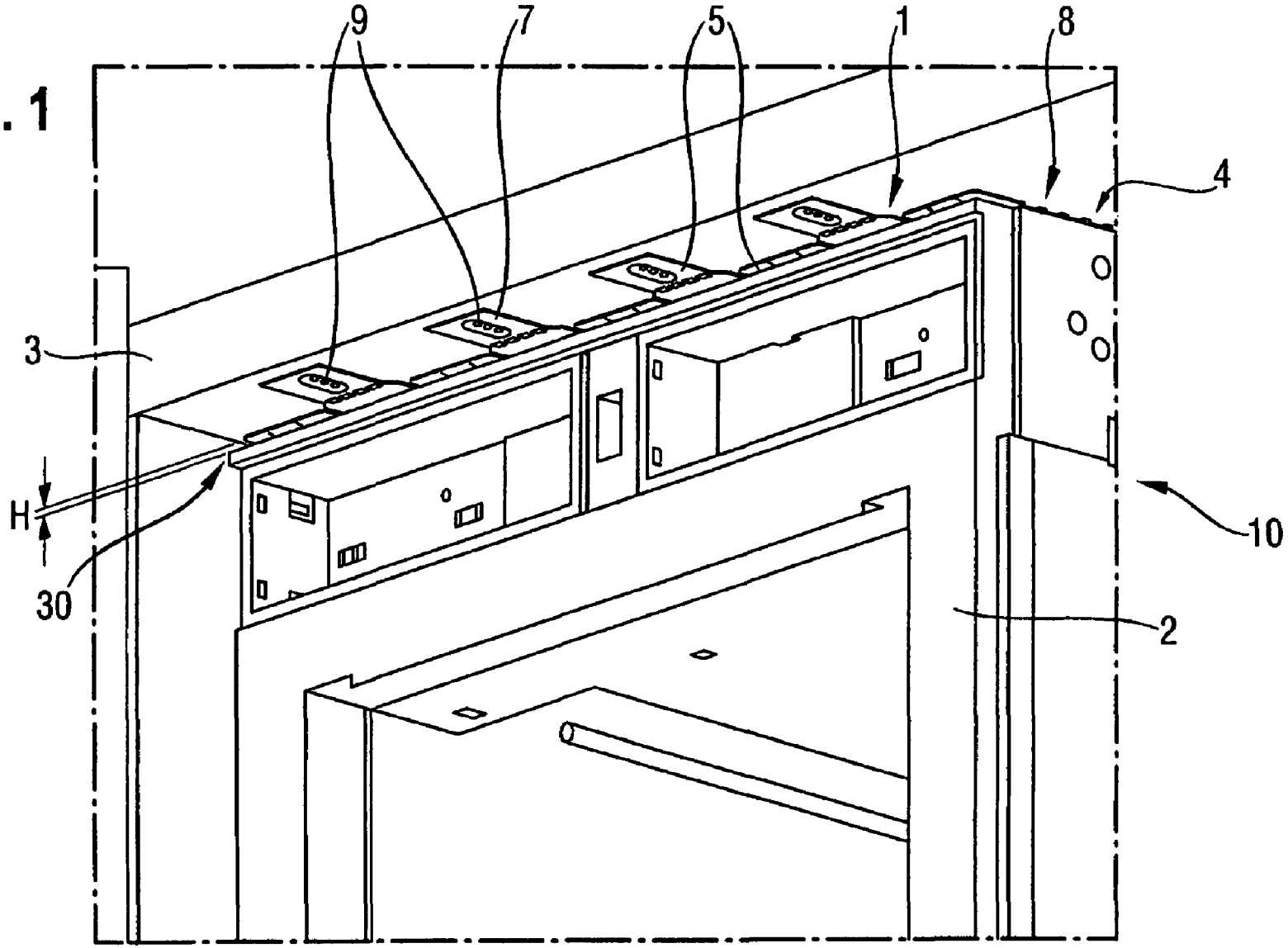
FIG. 1 a built-in appliance secured by a securing strip in a furniture recess in a perspective view obliquely from below, FIG. 2 a connection system according to the invention in a perspective view obliquely from above, wherein a securing strip is secured on a vertical side wall of an adjacent furniture unit, FIG. 3 a connection system according to the invention in a perspective view obliquely from above, wherein a securing strip is secured on a horizontal surface of an adjacent furniture unit, FIG. 4 a securing system according to the invention in a perspective view obliquely from above, FIG. 5 a securing strip for the securing system according to FIG. 4 in a perspective view obliquely from above, FIG. 6 the securing system according to FIG. 4 connected to a furniture unit and a built-in appliance in a vertical sectional view, and FIG. 7 the securing system according to FIG. 4 in a vertical sectional view.

FIG. 1 shows a built-in appliance 2 with a securing strip 5 of a connection system according to the invention 1 secured on a furniture unit 3. The built-in appliance 2 is provided as a refrigerator which is inserted in a furniture recess 4. The recess 4 is slightly larger than the built-in appliance 2 so that the connection system 1 has to achieve a certain overall height H in order to bridge a gap 30 between the built-in appliance 2 and the furniture unit 3. The built-in appliance 2 and the furniture unit 3 form a part of a furniture unit arrangement 10. The securing strip 5 is secured by means of screws 9 on the furniture unit 3. This is achieved by first securing elements 7 on the securing strip 5 which are provided as straps 31 extending outward from the securing strip (see FIG. 2) with openings for the screws 9. The securing strip 5 is secured with second securing elements 8 on the built-in appliance 2.

Figure 2:
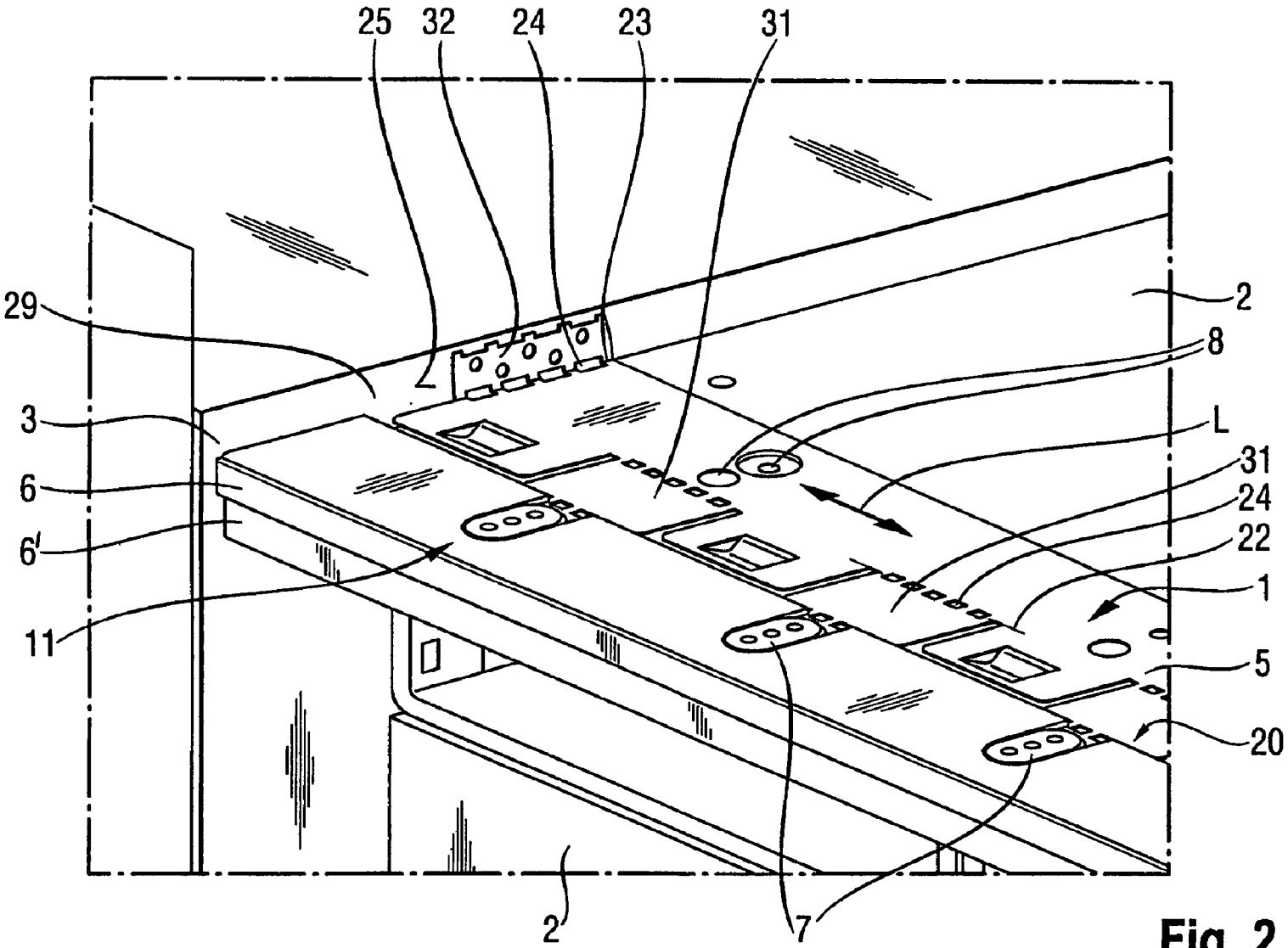

FIG. 2 shows the connection system 1 in a perspective view obliquely from above, wherein, for greater clarity, the furniture unit 3 arranged above the built-in appliance 2 is not shown. The connection system 1 is secured by the first securing elements 7 on the (not shown) furniture unit 3 arranged thereabove. The securing strip 5 is screwed with second securing elements 8 on the built-in appliance 2. The connection system 1 has a first cover strip 6 and a second cover strip 6', which is connected or secured to the securing strip 5. The first cover strip 6 is secured by means of a first receptacle 11 on or to the securing strip 5. For this, the first securing elements 7 are embodied as a projection so that a furniture-unit-side recess 20 is created between the securing strip 5 and the furniture unit 3 into which the first cover strip 6 can be inserted. The securing strip 5 has a longitudinal direction L, along which folding lines 22 are formed by a cut-out 24 so that straps 31 on the securing strip 5 can be bent back in order to set the overall height H of the securing strip 5 at a specific clearance between the built-in appliance 2 and furniture unit 3 arranged thereabove. The strap 31 is bent upward along the folding line 22 and secured by the first securing element 7 on the furniture unit 3. The securing strip 5 also has transverse folding lines 23 extending substantially perpendicularly to the longitudinal direction L, along which the securing strip 5 can be bent back in order to secure the securing strip 5 on an adjacent furniture unit 3 arranged next to the built-in appliance 2. In FIG. 2, a bending section 32 of securing strip 5 is bent upward along the transverse folding line 23 by 90° in order to create a connection of the securing strip 5 to a surface 25 of a side wall 29 of a furniture unit 3 arranged next to the built-in appliance 2.

Figure 3:
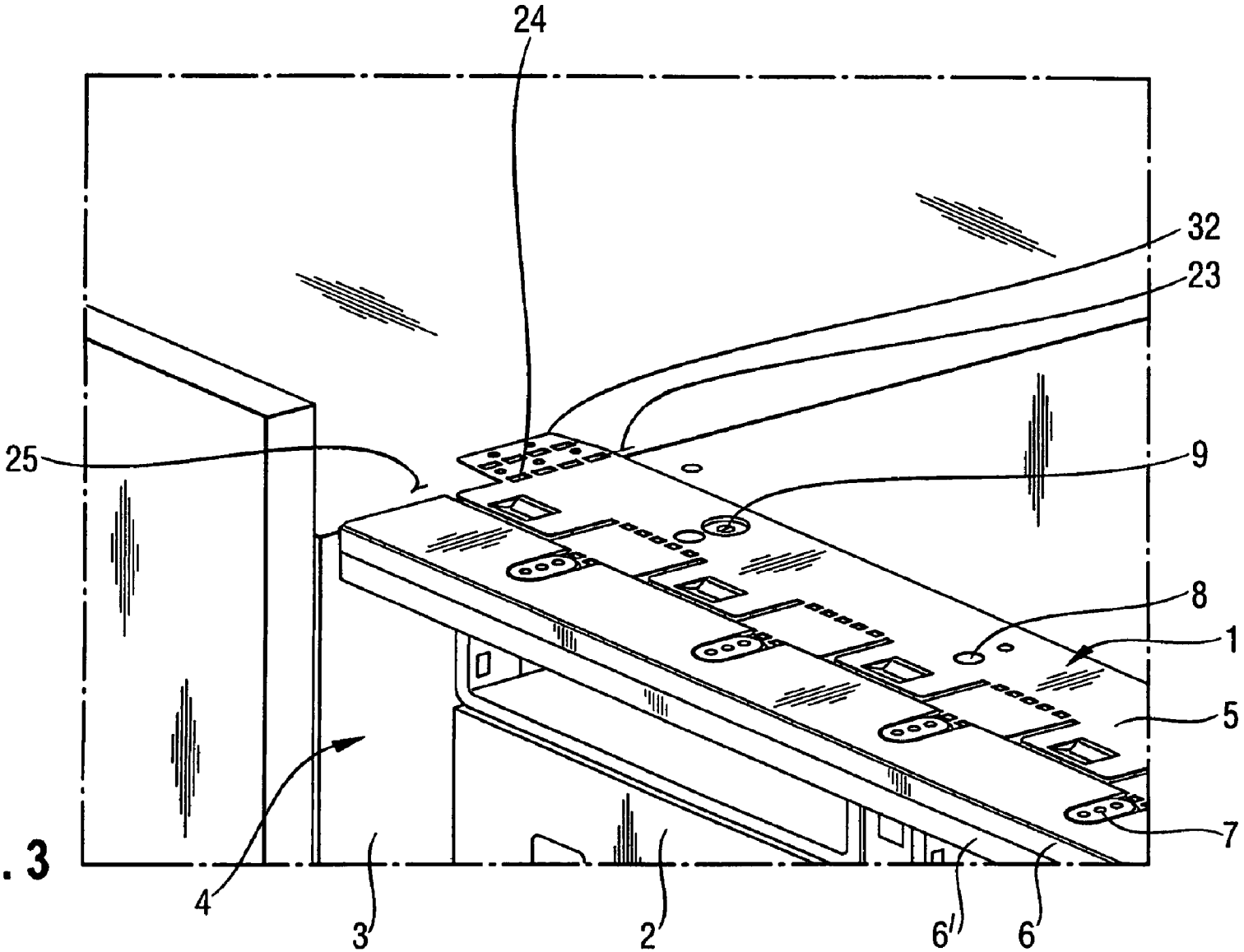

FIG. 3 shows the connection system 1 in a perspective view obliquely from above as in FIG. 2, with, however, the securing strip 5 being secured by the bending section 32 on a horizontal surface 25 of a furniture unit 3 arranged next to the built-in appliance 2. Since, in this case, the surface 25 is horizontal and lies at the same height as the securing strip 5, the bending section 32 does not have to bend along the transverse folding line 23.

Figure 4:
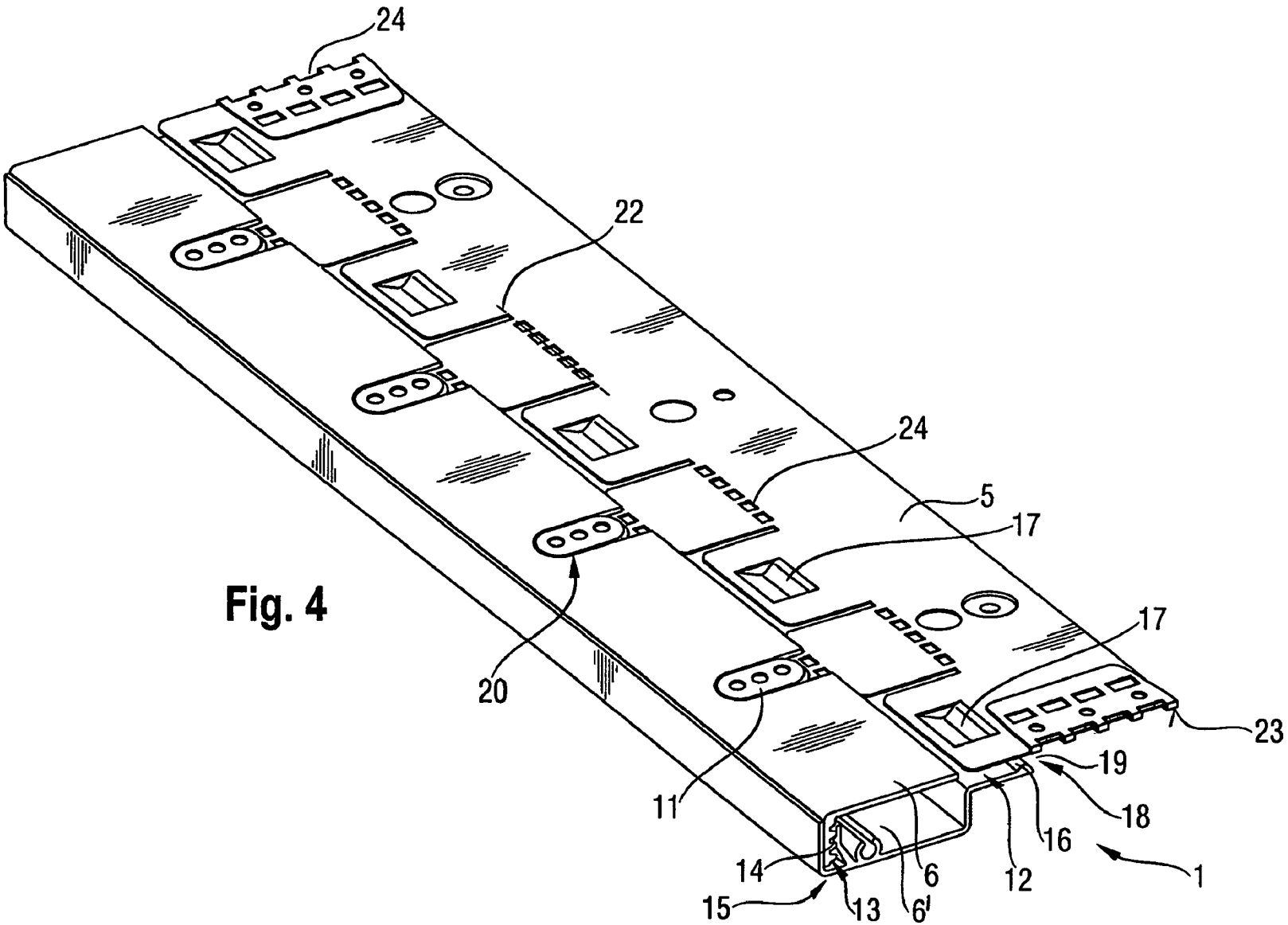

FIG. 4 shows the connection system according to the invention 1 in a perspective view obliquely from above. It is evident that on the securing strip 5, the first cover strip 6 is secured by means of the first receptacle 11 and the second cover strip 6' is secured by means of a second receptacle 12. The two cover strips 6, 6' are connected to each other by means of connecting elements 13. The first 6 and the second 6' cover strip are connected with an overlap 15. The connection of the two cover strips 6, 6' is secured by latching elements 14 to prevent unintentional detachment. However, the latching elements 14 in principle permit detachability of the cover strips 6, 6'. The second receptacle 12 is formed by an appliance-side recess 18 on the securing strip 5, which forms an appliance-side groove 19 between the securing strip 5 and the built-in appliance. The appliance-side groove can, for example, be formed by a projection (not shown) on the securing strip 5 extending toward the built-in appliance 2 and which serves, in particular, to secure the securing strip 5 on the built-in appliance 2. Provided on the second receptacle 12 are securing-side latching elements 17 by means of which the second cover strip 6' is fixed and secured to prevent unintentional detachment or sliding out of the appliance-side groove 19. In addition, cover-strip-side latching elements 16 are provided which engage with the securing-side latching elements 17 and hence form a latch connection between the cover strip 6, 6' and the securing strip 5.

Figure 5:
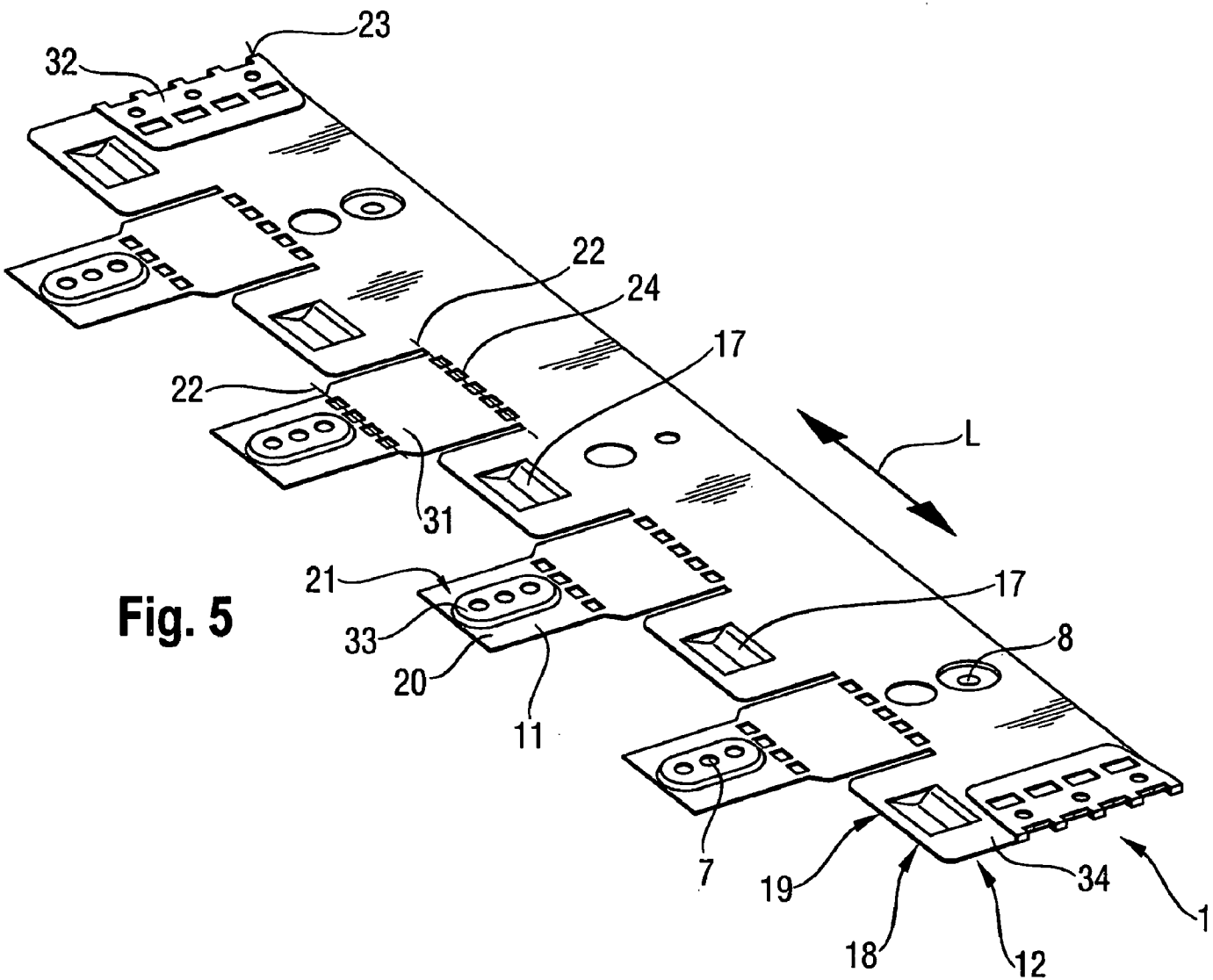

FIG. 5 shows the securing strip 5 of the connection system 1 with the straps 31 which can be bent back along the folding lines 22 defined by the cut-out 24 in order to bridge a gap between the built-in appliance 2 and a furniture unit 3 arranged thereabove. The strap 31 has a projection 33, which is formed by the first securing elements 7 for connection to the furniture unit 3 and which, by the creation of a furniture-unit-side recess 20 on the securing strip 5 and the furniture-unit-side groove 21 on the securing strip 5 created in this way, creates the first receptacle 11 for the first cover strip 6. In a corresponding way, the second receptacle 12 to receive the second cover strip 6 is formed by means of a second strap 34 of a securing strip 5 and the appliance-side recess 18, which creates the appliance-side groove 19 between the securing strip 5 and the built-in appliance 2. The bending sections 32 are bent about the transverse folding lines 23 by 180°, since at this point the securing strip 5 is not secured to an adjacent side wall 29 of a furniture unit 3 arranged next to built-in appliance 2.

Figure 6:
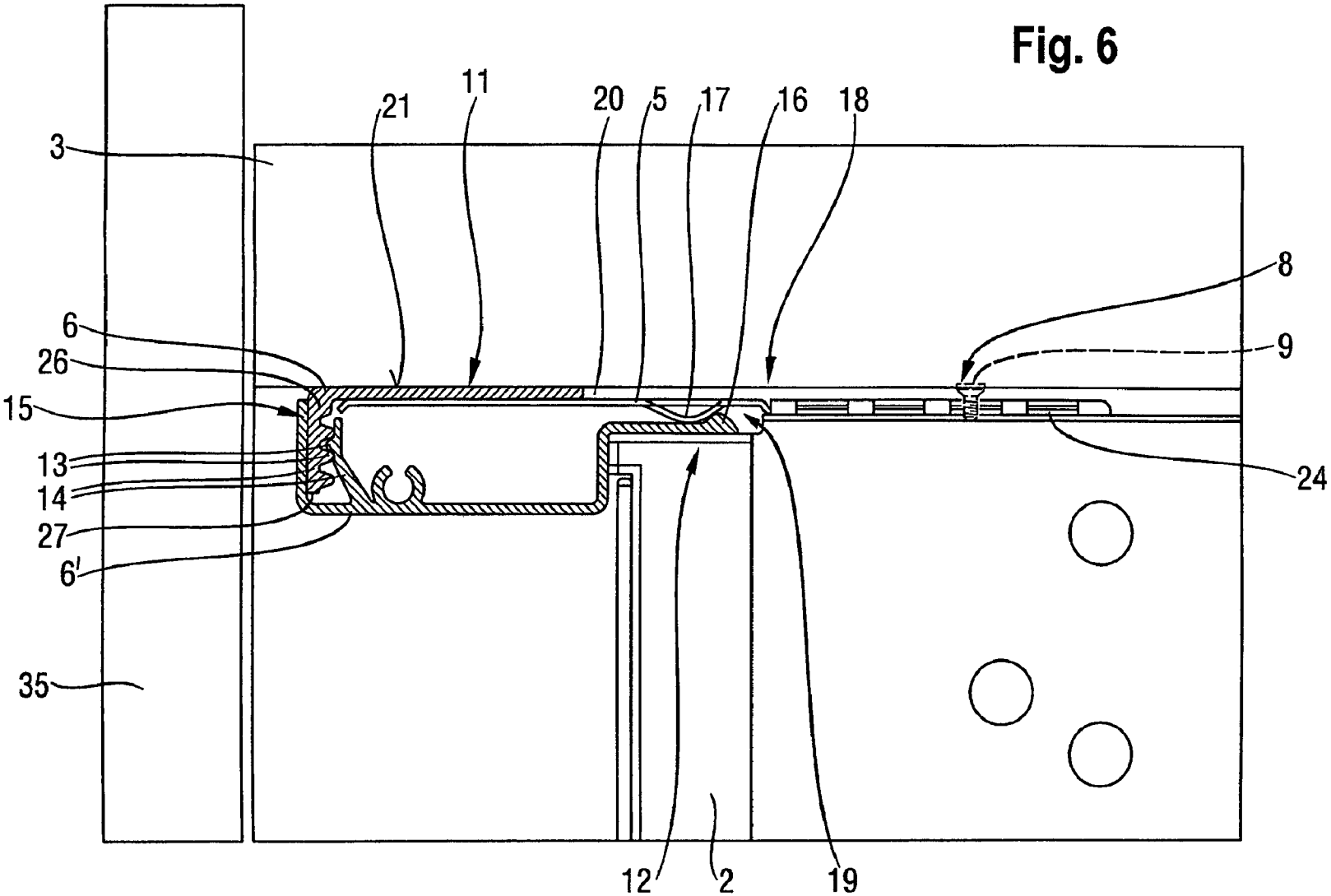

FIG. 6 shows the connection system 1 in a vertical sectional view from the side. The securing strip 5 is secured by the second securing element 8 and the screw 9 on the built-in appliance 2. The securing of the securing strip 5 on the furniture unit cannot be seen here since it takes place in a vertical sectional plane offset parallel to the vertical sectional plane shown. The first cover strip 6 is connected by the first receptacle 11 to the securing strip 5 by being inserted through the furniture-unit-side groove 21 formed by the furniture-unit-side recess 20 between the securing strip 5 and the furniture unit 3. The second cover strip 6' is secured on the second receptacle 12 by being inserted into the appliance-side groove 19 formed by the appliance-side recess 18 between the securing strip 5 and the built-in appliance 2. The unintentional detachment 30 of the second cover strip 6' is prevented by the interaction of the securing-side latching elements 17 on the securing strip 5 and the cover-strip-side latching elements 16 on the cover strip 6'. The two cover strips 6, 6' have an overlap 15, which can be varied in accordance with the clearances to be bridged by the connection system 1 between the built-in appliance 2 and the furniture unit 3 located thereabove. The two cover strips 6, 6' are latched to each other by the latching elements 14 to prevent unintentional detachment. The connecting elements 13 enable the setting of different overlaps 15. The first cover strip 6 has a break-off edge 27 extending along the longitudinal direction L along which the width B (see FIG. 7) of the cover strip 6, 6' can be reduced so that different overlaps 15 can be set.

Figure 7:
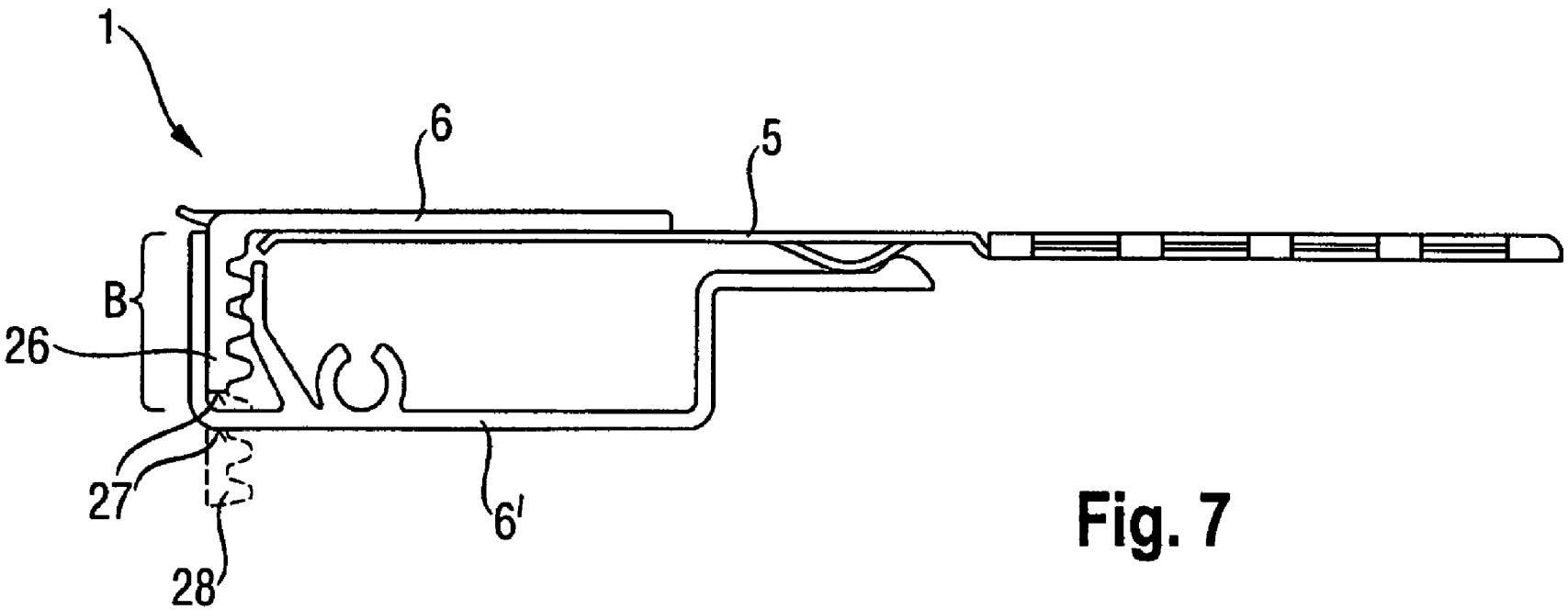

FIG. 7 shows the connection system 1 with the securing strip 5 and the two cover strips 6, 6'. The width B of a longitudinal side 26 of the first cover strip 6 can be reduced by separating a part to be separated 28 (shown as a dotted line) along the break-off edge 27. In the case of larger gaps 30 between the built-in appliance 2 and the adjacent furniture unit 3, the part 28 is not broken off. The width B can be reduced in steps along the break-off edges 27.

The invention relates to a connection system 1 for connecting a built-in appliance 2 to a furniture unit 3, in particular to a furniture recess 4, comprising a securing strip 5 with first securing elements 9 for securing to the furniture unit side of the securing strip 5 and second securing elements 8 for securing to the appliance side of the securing strip 5 and at least one cover strip 6 which can be attached on the securing strip 5, with the securing strip 5 having at least one receptacle 11, 12 for securing the cover strip 6, 6' and the securing strip 5 and a furniture unit arrangement 10, in particular a kitchen range comprising a plurality of furniture units 3, with at least one furniture unit 3 having a recess 4, and at least one built-in appliance 2, with the built-in appliance 2 being built into the recess 4, with the built-in appliance 2 being connected by the connection system according to the invention 1 to the furniture unit 3. The invention is characterized by the fact that this makes it possible to obtain a mechanically solid connection which is simple, rapid and reliable and which fulfils a paneling function between the built-in appliance 2 and the furniture unit 3 even when there is a misalignment between the furniture unit 3 and the built-in appliance 2.

LIST OF REFERENCE NUMBERS

1 Connection system
2 Built-in appliance
3 Furniture unit
4 Furniture recess
5 Securing strip
6, Cover strip
7 First securing elements
8 Second securing elements
9 Screws
10 Furniture unit arrangement
11 First receptacle
12 Second receptacle
13 Connecting elements
14 Latching elements
15 Overlap
16 Cover-strip-side latching elements
17 Securing-side latching elements
18 Appliance-side recess
19 Appliance-side groove
20 Furniture-unit-side recess
21 Furniture-unit-side groove
22 Folding lines
23 Transverse folding lines
24 Cut-outs
25 Surface
26 Longitudinal side
27 Break-off edge
28 Part to be separated
29 Side wall
30 Gap
31 Strap
32 Bending section
33 Projection
34 Second strap
35 Door
L Longitudinal direction
H Overall height
B Width

The invention claimed is:

1. A connection system for connecting a built-in appliance to a furniture unit, where a gap exists between the built-in appliance and the furniture unit, the system comprising:

a securing strip, having first securing elements for securing to the furniture unit, and second securing elements for securing to the built-in appliance; and at least one cover strip removably attached to the securing strip such that the cover strip is configured to be removable from the securing strip without the securing strip being removed from the built-in appliance, and the cover strip is configured to be removable from the securing strip without the securing strip being removed from the furniture unit, wherein the securing strip has at least one receptacle for securing the cover strip to the securing strip, and the securing strip is bendable such that a distance between the first securing elements and the second securing elements is adjustable, the distance corresponding to a width of the gap between the built-in appliance and the furniture unit.

2. The connection system as set forth in claim 1, wherein the furniture unit has a furniture recess for receiving the appliance.

3. The system as claimed in claim 1, wherein the at least one cover strip includes at least two cover strips; and the securing strip includes at least two receptacles for securing the two cover strips to the securing strip.

4. The system as claimed in claim 3, wherein at least one of the two cover strips includes connecting elements, whereby the cover strips can be connected to each other.

5. The system as claimed in claim 4, wherein the connecting elements are latching elements.

6. The system as claimed in claim 3, wherein the two cover strips are arranged with an overlap.

7. The system as claimed in claim 6, wherein the overlap is adjustable.

8. The system as claimed in claim 7, wherein the overlap is adjustable in steps.

9. The system as claimed in claim 1, wherein the cover strip includes cover-strip-side latching elements for latching the cover strip to the securing strip.

10. The system as claimed in claim 1, wherein the securing strip includes securing-side latching elements for latching the cover strip to the securing strip.

11. The system as claimed in claim 1, wherein the securing strip includes at least one appliance-side recess for forming an appliance-side groove between the securing strip and the built-in appliance whereby the cover strip is configured to be inserted into the appliance-side groove.

12. The system as claimed in claim 1, wherein the securing strip includes at least one furniture-unit-side recess for forming a furniture-unit-side groove between the securing strip and the furniture unit, whereby the cover strip is configured to be inserted into the furniture-unit-side groove.

13. The system as claimed in claim 1, wherein the securing elements include holes for screws.

14. The system as claimed in claim 1, wherein the securing strip is formed in a flat-ribbon shape, with at least one folding line extending parallel to the longitudinal direction of the securing strip for setting an overall height of the securing strip, the overall height being the distance between the first securing elements and the second securing elements.

15. The system as claimed in claim 14, wherein the at least one folding line includes at least two folding lines.

16. The system as claimed in claim 14, wherein the overall height of the securing strip is in a range of 1 mm to 20 mm.

17. The system as claim in claim 14, wherein the overall height of the securing strip is in a range of 1 mm to 10 mm.

18. The system as claimed in claim 14, wherein the folding line is formed by cut-outs.

19. The system as claimed in claim 18, wherein the cut outs are punched-out portions.

20. The system as claimed in claim 1, wherein the securing strip is formed in a flat-ribbon shape, the securing strip having at least one transverse folding line extending perpendicularly to the longitudinal direction of the securing strip for securing the securing strip on at least one surface extending transverse to the longitudinal direction of the securing strip.

21. The system as claimed in claim 20, wherein the surface is a side wall of the furniture unit.

22. The system as claimed in claim 20, wherein the transverse folding line is formed by cut-outs.

23. The system as claimed in claim 22, wherein the cut-outs are punched-out portions.

24. The system as claimed in claim 1, wherein the cover strip includes a longitudinal side and a break-off edge, whereby the width of the longitudinal side may be reduced by the break-off edge.

25. A connection system for connecting a built-in appliance to a furniture unit, the system comprising:

a securing strip having first securing elements for securing a furniture unit side of the securing strip to the furniture unit, and second securing elements for securing an appliance side of the securing strip to the built-in appliance; and two cover strips attached to the securing strip, wherein the securing strip includes at least two receptacles for securing the two cover strips to the securing strip, the two cover strips are arranged with an overlap, and the overlap includes a groove and a tongue.

26. A furniture unit arrangement comprising:

a plurality of furniture units, at least one furniture unit having a recess;

at least one built-in appliance, the built-in appliance being built into the recess;

a securing strip having first securing elements secured to one of the furniture units, and second securing elements secured to the built-in appliance; and at least one cover strip removably attached to the securing strip such that the cover strip is configured to be removable from the securing strip without the securing strip being removed from the built-in appliance, and the cover strip is configured to be removable from the securing strip without the securing strip being removed from the furniture unit, wherein a gap exists between the built-in appliance and the one of the furniture units, the securing strip has at least one receptacle for securing the cover strip to the securing strip, and the securing strip is bendable such that a distance between the first securing elements and the second securing elements is adjustable, the distance being adaptable to a width of the gap between the built-in appliance and the one of the furniture units.

27. The furniture unit arrangement as claimed in claim 26, wherein the built-in appliance is a kitchen range.

* * * * *